US005109591A

United States Patent [19]

Hung

[11] Patent Number: 5,109,591

[45] Date of Patent: May 5, 1992

[54] PLIERS FOR CUTTING AND PEELING TELCO CORD AND PRESS-FITTING SUCH CORD TO A TELCO PLUG

[76] Inventor: Ying-Teh Hung, No. 9 Ta-Tung St., Industrial District Tu-Cheng Hsiang, Taipei Hsien, Taiwan

[21] Appl. No.: 696,361

[22] Filed: May 6, 1991

[51] Int. Cl.[5] ..... H01R 43/04

[52] U.S. Cl. ..... 29/566.4; 29/33 M; 29/751; 7/107

[58] Field of Search ..... 7/107, 125, 127, 129, 7/130, 131, 132, 133, 134, 158; 29/566.4, 566.1, 566.2, 566.3, 750, 751, 747, 748, 33 M, 752, 753; 81/9.4, 9.44; 30/90.1

[56] References Cited

U.S. PATENT DOCUMENTS

| | | | |
|---|---|---|---|
| 4,429,451 | 2/1984 | Angelico | 29/566.4 |
| 4,480,374 | 11/1984 | Meyer | 29/566.4 |
| 4,557,034 | 12/1985 | Pfundt | 29/566.4 |
| 4,625,386 | 12/1986 | Bieganski | 29/566.4 |
| 4,713,874 | 12/1987 | Schwartz | 7/107 |
| 4,754,636 | 7/1988 | Kautz et al. | 29/751 |
| 4,862,580 | 9/1989 | Wang | 29/566.4 |

*Primary Examiner*—Roscoe V. Parker
*Attorney, Agent, or Firm*—Harrison & Egbert

[57] ABSTRACT

Pliers for cutting, peeling telco cord, and press-fitting such cord to a telco plug having three cavities for three plugs of different size is a tool for cutting neatly a telco cord, for peeling its clad, and for press-fitting such a cord onto a telco plug so as to secure the cord in the plug.

1 Claim, 5 Drawing Sheets

PLIERS FOR CUTTING AND PEELING TELCO CORD AND PRESS-FITTING SUCH CORD TO A TELCO PLUG

BACKGROUND

1. Field of the Invention

This invention relates to pliers for use in cutting telco cord or peeling its clad to facilitate easy press-fitting telco cord to a telco plug.

2. Description of Prior Art

Most telco technicians have to cut and peel telco cord in order to make it fit to be pressed to a telco plug.

Herefore many pliers have been proposed and implemented for peeling and press-fitting telco cord.

One such tool can only peel cord, but can not press-fit it to a plug. Another type of tool can press-fit only one cord to a plug at a time after the cord has been peeled by other pliers because it can not peel cord.

A telco plug (C), as shown in FIG. 6 and 7, comprises a locking wedge (H) and a set of conducting forks on a sliding block (P).

Telco cord (W) comprises clad (O) and aligned color covers (L).

After clad (O) has been peeled, cord (W) can be inserted into plug (C). When locking wedge (H) and said forks on block (P) are pressed onto cord (W), they are fitted together to secure from being disassembled.

Most technicians, therefore, would find it desirable to have a tool which could cut and peel telco cord and press-fit three cord to a plug at a time.

OBJECTS AND ADVANTAGES

Accordingly we claim the following as our objects and advantages of the invention: to provide a tool for cutting cord and for easily separating the clad from a cord, to provide a tool for fitting cord to a plug, and to provide such a tool which requires a minimum of skill and training to use.

Readers will find further objects and advantages of the invention from a consideration of the ensuing description and the accompanying drawings.

DRAWING FIGURES

DRAWING REFERENCE NUMERALS

Figure 1:
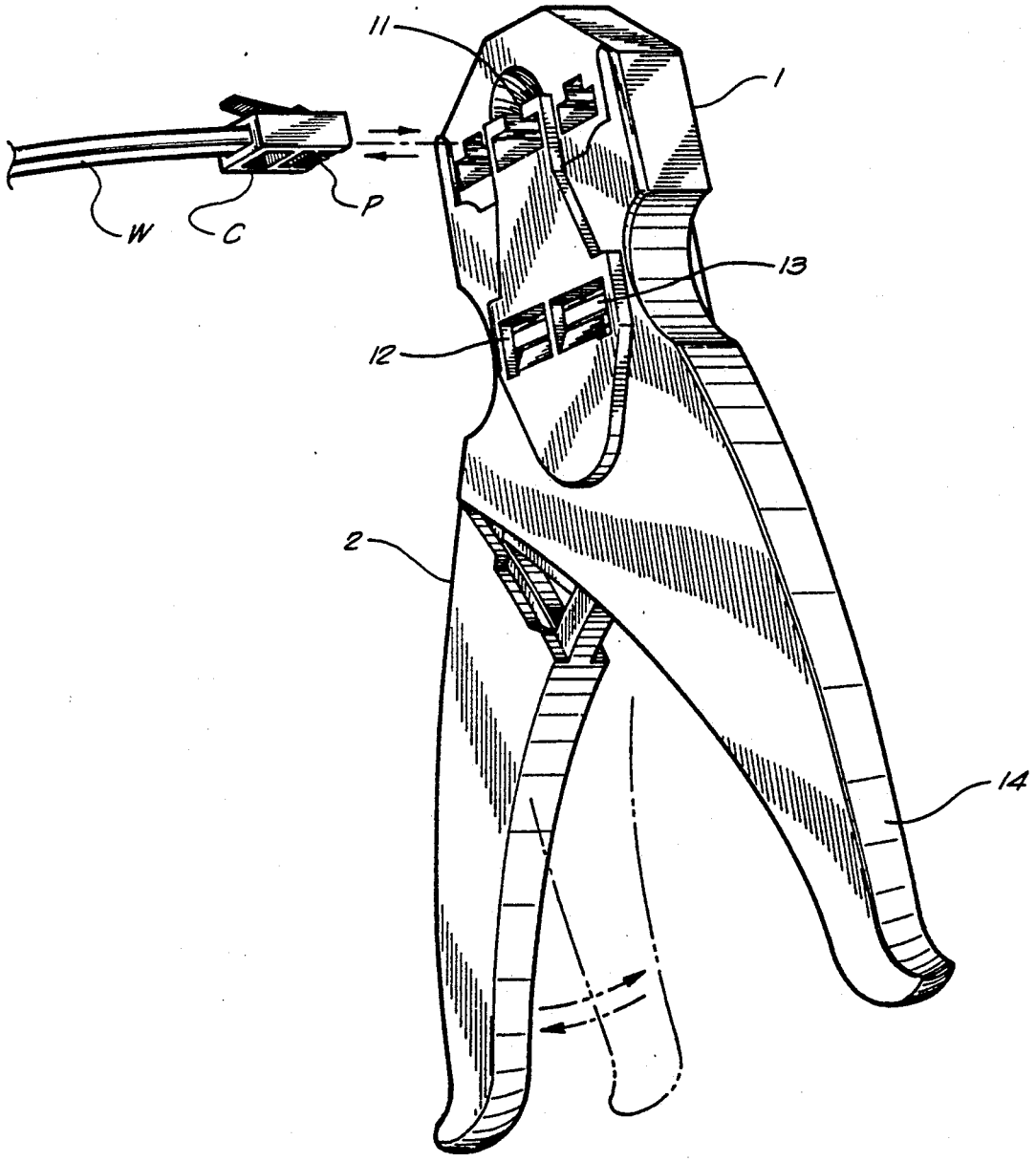
FIG. 1 shows a perspective view of a telco cord and the invention.

C plug
P sliding block of C
H looking wedge of C
W telco cord
O clad of W
L aligned color covers of W
1 main body
11 jack on 1
12 opening for peeling clad of W
13 the same as 12
14 handle of 1
15 opening for chips of W
16 peeling blade
17 cutting blade
2 adjustable handle of 1
21 pivot support
22 pivot
23 opening of cutting W
24 cutting blade
3 sliding seat
31 and 32 pressing block
33 peeling blade the same as 16
34 long hole
35 and 36 cavity for W
37 passage for chips from W
38 spring
39 post on 3
3R right shoulder of 3
3L left shoulder of 3

DETAILED DESCRIPTION

As shown in FIG. 1, main body 1 has three plug cavities 11 which are respectively fit for 4-pin, 6-pin, and 8-pin plug to insert in. 8-pin cavity 11 which is twice as deep as the other two is located in a convex in the middle of main body 1. When a user grips handle 14 and adjustable handle 2 with his hand, a sliding seat 3 will be pushed up to squeeze pressing blocks 31 and 32 to press-fit sliding block P and locking wedge H of plug C onto telco cord W and secure cord W to plug C.

Figure 2:
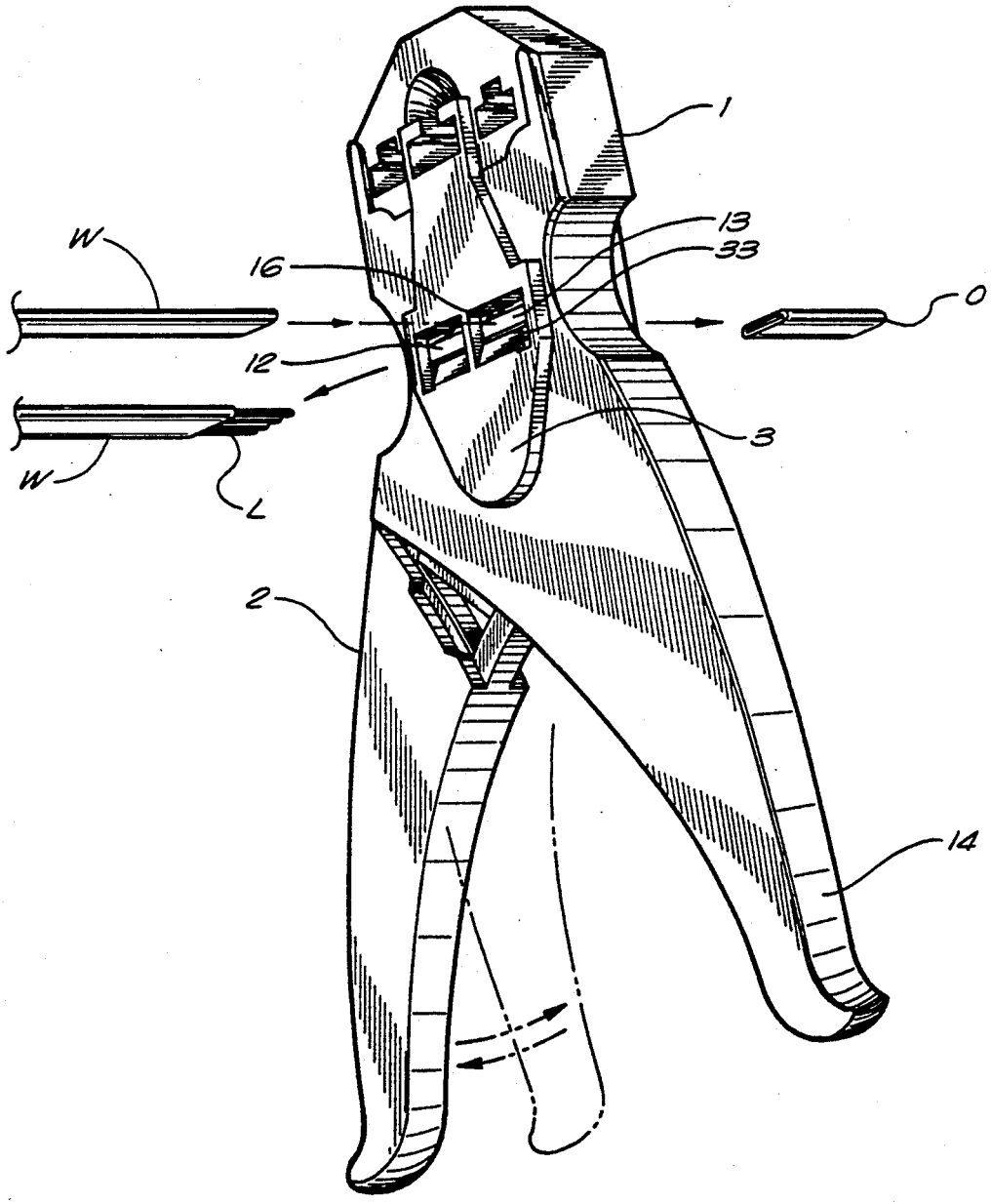
FIG. 2 shows a view of the invention in use peeling the clad of a cord.

As shown in FIG. 2, cord W can be inserted into an opening for peeling 12 or 13, to be peeled down its clad O by peeling blades 33 on sliding seat 3 and by peeling blade 16 on main body 1 when two handles 2 and 14 are gripped by a hand. The chipped clad O can be thrown away from cavities 36 and 36 through passage for chips 37 out of opening for chips 15.

Figure 3:
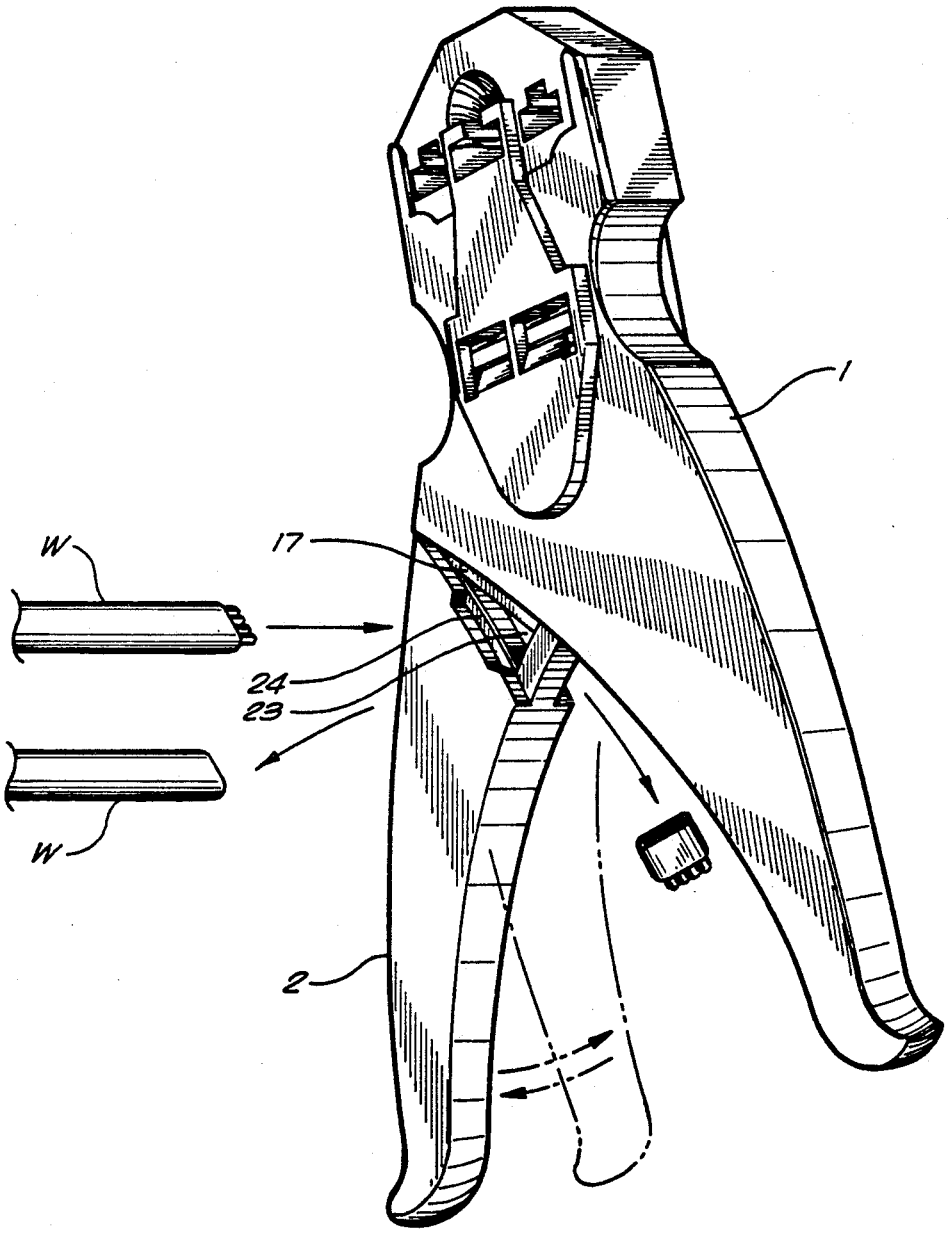
FIG. 3 shows a view of the invention in use cutting a cord.

As shown in FIG. 3, cord W can be inserted in opening for cutting 23 and be cut neatly by a cutting blade 17 on handle 14 and another blade 24 on adjustable handle 2.

Figure 4:
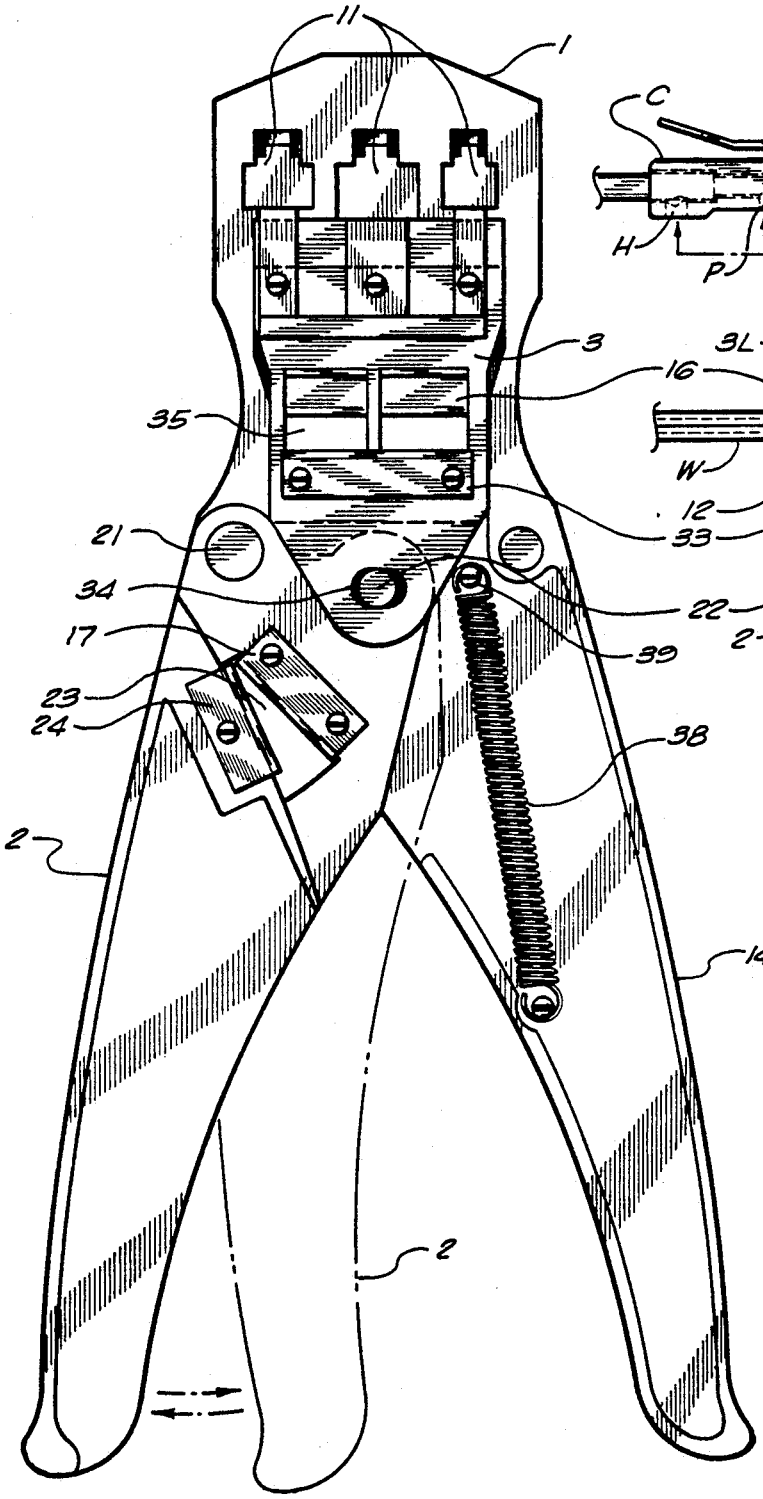
FIG. 4 shows a sectional view of the invention.
Figure 5:
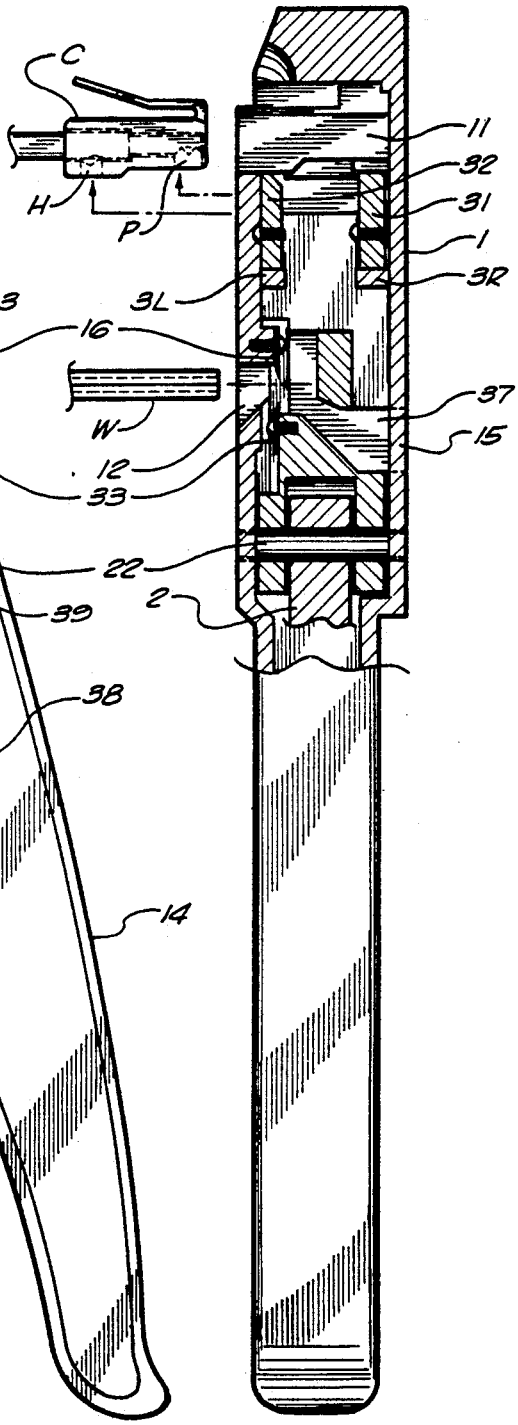
FIG. 5 shows a side-sectional view of the invention in use press-fitting a cord to a plug and peeling its clad.
Figure 6:
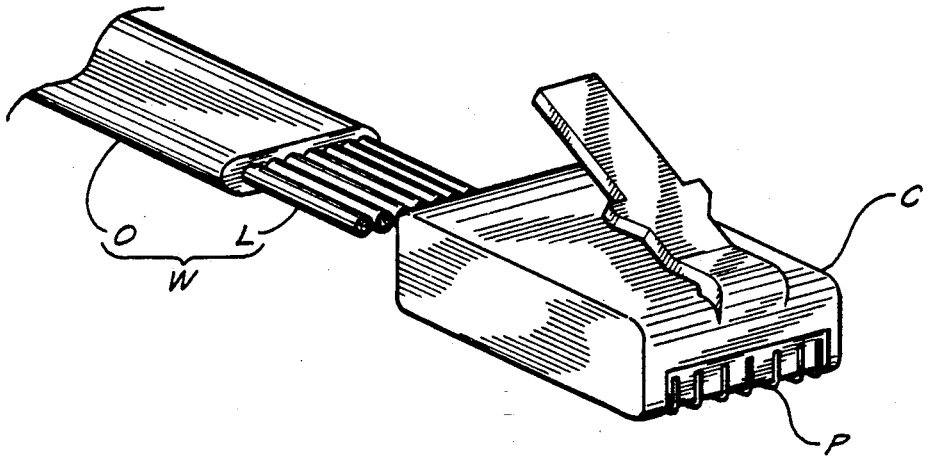
FIG. 6 shows a perspective view of a plug and a partly peeled cord.
Figure 7:
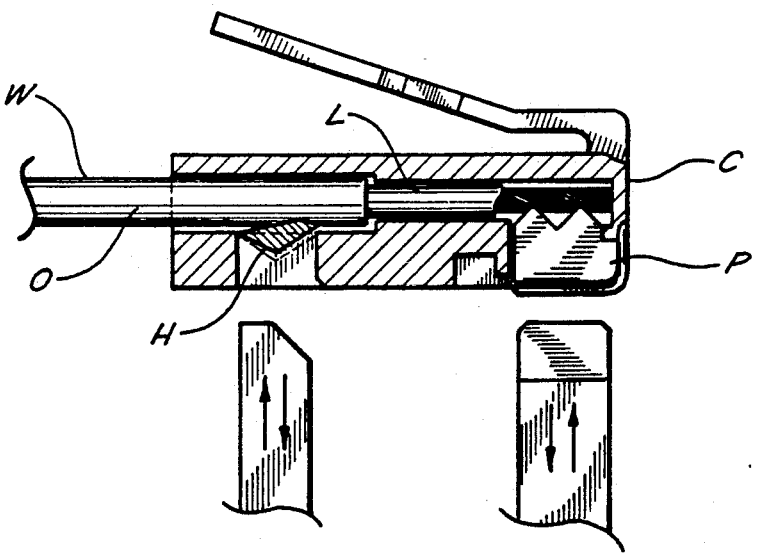
FIG. 7 shows a side-sectional view of plug being press-fitted onto an inserted cord.

As shown in FIG. 4, and FIG. 5, a sliding seat 3 mounted in main body 1 has a long hole 34 at its end to be penetrated through by a pivot 22 which is on adjustable handle 2. Seat 3 has a post 39 at the end of its right side. Post 39 is seized by a collar of spring 38 which connects to the end of handle 14 and is hidden from view in the interior of handle 14.

There are two pressing blocks 31 and 32 on right shoulder 3R and left shoulder 3L respectively. These two pressing blocks 31, 32 are both shaped like "E", screwed onto the head of sliding seat 3, disposed parallelly, and always pushed or pulled simultaneously. The three heads of left pressing block 32 have a slope on each of them so that they may press-fit locking wedge H of telco plug C onto telco cord W. The three heads of right pressing block 31 is to press-fit conducting thorns of sliding block P on plug C into color covers L of cord W. The length of each head is different so that it may match three different cavities 11 for three different sizes of telco plugs.

When a user gripes adjustable handle 2 to handle 14, sliding seat 3 moves up and squeezes pressing blocks 31 and 32 to press-fit locking wedge H and sliding block P onto cord W; when he looses grip on it, sliding seat 3 and adjustable handle 2 will be moved back to their normal positions by said spring 38.

What is claimed is:

1. Pliers for cutting, peeling telco cord, and press-fitting telco and cord to a plug comprising:

a main body, a sliding seat, an adjustable handle, a set of two pressing blocks, wherein said main body has a sliding passage for said sliding seat; three cavities for receiving telco plugs of three different sizes are disposed above and adjacent said sliding passage;

said sliding seat having two aligned openings for cord peeling; a pivot support for a pivot joining with said adjustable handle; an opening for cutting cord is between said main body and said adjustable handle; the end of said sliding seat has a long hole for receiving a pivot on said adjustable handle; said adjustable handle can thus have a lever motion to push up and down said sliding seat;

said set of two pressing blocks are parallelly mounted on shoulders of said sliding seat, screwed on the sliding seat, and always pushed and pulled simultaneously by it; each of said pressing blocks having three kinds; said three heads of each said two pressing blocks being different in length so that they can match said three cavities of different sizes;

the end of said sliding seat has a right edge with a post on it; said post is seized by a collar of a spring of which the other collar is fitted to the end of another handle on said main body so that said sliding seat and said adjustable handle may be pulled back to their original positions;

the center of said sliding seat has cavities, a passage, and an opening for chips of clad to be thrown away; a peeling blade screwed on said sliding seat and another blade screwed on said main body can peel clad in front of said cavities; said pivot on said adjustable handle is mounted in said long hole at the end of said sliding seat and a pivot support on said adjustable handle is joined to said main body;

a blade screwed on adjustable handle and a blade screwed on said another handle of said main body can cut telco cord at the both sides of said opening for cutting; these two blades can be performed as scissors and chips of telco cord may be dropped away from back of them directly.

* * * * *